US008610699B2

(12) United States Patent
Akiyama et al.

(10) Patent No.: US 8,610,699 B2
(45) Date of Patent: Dec. 17, 2013

(54) DISPLAY DEVICE

(75) Inventors: Kenichi Akiyama, Mobara (JP); Yoshihiro Kotani, Chiba (JP); Shuuichirou Matsumoto, Mobara (JP)

(73) Assignees: Japan Display Inc., Tokyo (JP); Panasonic Liquid Crystal Display Co., Ltd., Hyogo-ken (JP)

( * ) Notice: Subject to any disclaimer, the term of this patent is extended or adjusted under 35 U.S.C. 154(b) by 819 days.

(21) Appl. No.: 12/700,787

(22) Filed: Feb. 5, 2010

(65) Prior Publication Data

US 2010/0245320 A1 Sep. 30, 2010

(30) Foreign Application Priority Data

Mar. 31, 2009 (JP) ..... 2009-087680

(51) Int. Cl.
*G09G 5/00* (2006.01)

(52) U.S. Cl.
USPC ..... 345/211

(58) Field of Classification Search
USPC ..... 345/87, 211; 341/144, 148
See application file for complete search history.

(56) References Cited

U.S. PATENT DOCUMENTS

| | | | | |
|---|---|---|---|---|
| 4,281,319 | A * | 7/1981 | Roberts, Jr. | 341/136 |
| 2006/0256616 | A1* | 11/2006 | Honda et al. | 365/185.11 |
| 2007/0091052 | A1* | 4/2007 | Tsuchi | 345/100 |
| 2009/0213051 | A1* | 8/2009 | Tsuchi | 345/87 |

FOREIGN PATENT DOCUMENTS

| | | |
|---|---|---|
| JP | 2001-034234 | 2/2001 |
| JP | 2008-111917 | 5/2008 |

* cited by examiner

*Primary Examiner* — William Boddie
*Assistant Examiner* — Sahlu Okebato
(74) *Attorney, Agent, or Firm* — Antonelli, Terry, Stout & Kraus, LLP.

(57) ABSTRACT

An object of the invention is to reduce the size of a decoder circuit of a display device. A decoder circuit which outputs voltages corresponding to 8-bit digital values includes a pre-decoder section, which includes an A decoder, B decoder, and C decoder, each of which is configured of a matrix type decoder circuit which carries out a three bits' worth of decoding, and a tournament type decoder circuit which carries out a three bits' worth of decoding, a selection circuit which, having input thereinto three voltages output respectively from the A decoder, B decoder, and C decoder, and applied to three output signal lines, selects two voltages of the three input voltages using a bit with one of the digital values and applies them to two output signal lines, and an intermediate voltage output circuit which, having input thereinto the two voltages selected by the selection circuit, outputs a voltage which is the average of the two voltages.

9 Claims, 17 Drawing Sheets

| D<4:2> | OUTPUT |
|---|---|
| 000 | V<64> |
| 001 | V<56> |
| 010 | V<56> |
| 011 | V<48> |
| 100 | V<48> |
| 101 | V<40> |
| 110 | V<40> |
| 111 | V<32> |

| D<7:5> | OUTPUT |
|---|---|
| 000 | VA8 |
| 001 | VA7 |
| 010 | VA6 |
| 011 | VA5 |
| 100 | VA4 |
| 101 | VA3 |
| 110 | VA2 |
| 111 | VA1 |

| D<4:2> | OUTPUT |
|---|---|
| 000 | V<62> |
| 001 | V<58> |
| 010 | V<54> |
| 011 | V<50> |
| 100 | V<46> |
| 101 | V<42> |
| 110 | V<38> |
| 111 | V<34> |

| D<7:5> | OUTPUT |
|---|---|
| 000 | VB8 |
| 001 | VB7 |
| 010 | VB6 |
| 011 | VB5 |
| 100 | VB4 |
| 101 | VB3 |
| 110 | VB2 |
| 111 | VB1 |

| D<4:3> | OUTPUT |
|---|---|
| 00 | V<60> |
| 01 | V<52> |
| 10 | V<44> |
| 11 | V<36> |

| D<7:5> | OUTPUT |
|---|---|
| 000 | VC8 |
| 001 | VC7 |
| 010 | VC6 |
| 011 | VC5 |
| 100 | VC4 |
| 101 | VC3 |
| 110 | VC2 |
| 111 | VC1 |

| D<2:0> | Vout1 | Vout2 |
|---|---|---|
| 000 | VA | VA |
| 001 | VB | VA |
| 010 | VB | VB |
| 011 | VC | VB |
| 100 | VC | VC |
| 101 | VB | VC |
| 110 | VB | VB |
| 111 | VA | VB |

FIG. 22

| D<7> | D<6> | D<5> | D<4> | D<3> | D<2> | D<1> | D<0> | VA | VB | VC | Vout1 | Vout2 | Vout |
|---|---|---|---|---|---|---|---|---|---|---|---|---|---|
| 0 | 0 | 0 | 0 | 0 | 0 | 0 | 0 | 255 | 255 | – | 255 | 255 | 255 |
| 0 | 0 | 0 | 0 | 0 | 0 | 0 | 1 | – | 254 | – | 254 | 254 | 254 |
| 0 | 0 | 0 | 0 | 0 | 0 | 1 | 0 | – | 253 | 253 | 253 | 253 | 253 |
| 0 | 0 | 0 | 0 | 0 | 0 | 1 | 1 | – | – | 252 | 252 | 252 | 252 |
| 0 | 0 | 0 | 0 | 0 | 1 | 0 | 0 | – | 251 | 251 | 251 | 251 | 251 |
| 0 | 0 | 0 | 0 | 0 | 1 | 0 | 1 | – | 250 | – | 250 | 250 | 250 |
| 0 | 0 | 0 | 0 | 0 | 1 | 1 | 0 | 249 | 249 | – | 249 | 249 | 249 |
| 0 | 0 | 0 | 0 | 0 | 1 | 1 | 1 | 248 | – | – | 248 | 248 | 248 |
| 0 | 0 | 0 | 0 | 1 | 0 | 0 | 0 | 248 | 246 | 244 | 248 | 246 | 247 |
| 0 | 0 | 0 | 0 | 1 | 0 | 0 | 1 | 248 | 246 | 244 | 246 | 246 | 246 |
| 0 | 0 | 0 | 0 | 1 | 0 | 1 | 1 | 248 | 246 | 244 | 246 | 244 | 245 |
| 0 | 0 | 0 | 0 | 1 | 1 | 0 | 0 | 248 | 246 | 244 | 244 | 244 | 244 |
| 0 | 0 | 0 | 0 | 1 | 1 | 0 | 1 | 240 | 242 | 244 | 244 | 242 | 243 |
| 0 | 0 | 0 | 0 | 1 | 1 | 1 | 0 | 240 | 242 | 244 | 242 | 242 | 242 |
| 0 | 0 | 0 | 0 | 1 | 1 | 1 | 1 | 240 | 242 | 244 | 242 | 240 | 249 |
| 0 | 0 | 0 | 1 | 0 | 0 | 0 | 0 | 240 | 242 | 244 | 240 | 240 | 240 |
| 0 | 0 | 0 | 1 | 0 | 0 | 0 | 1 | 240 | 238 | 236 | 240 | 238 | 239 |
| 0 | 0 | 0 | 1 | 0 | 0 | 1 | 0 | 240 | 238 | 236 | 238 | 238 | 238 |
| 0 | 0 | 0 | 1 | 0 | 0 | 1 | 1 | 240 | 238 | 236 | 238 | 236 | 237 |
| 0 | 0 | 0 | 1 | 0 | 1 | 0 | 0 | 240 | 238 | 236 | 236 | 236 | 236 |
| 0 | 0 | 0 | 1 | 0 | 1 | 0 | 1 | 232 | 234 | 236 | 236 | 234 | 235 |

FIG. 23

| D<7> | D<6> | D<5> | D<4> | D<3> | D<2> | D<1> | D<0> | VA | VB | VC | Vout1 | Vout2 | Vout |
|---|---|---|---|---|---|---|---|---|---|---|---|---|---|
| 1 | 1 | 1 | 0 | 1 | 0 | 1 | 1 | 24 | 22 | 20 | 20 | 20 | 20 |
| 1 | 1 | 1 | 0 | 1 | 1 | 0 | 0 | 16 | 18 | 20 | 20 | 18 | 19 |
| 1 | 1 | 1 | 0 | 1 | 1 | 0 | 1 | 16 | 18 | 20 | 18 | 18 | 18 |
| 1 | 1 | 1 | 0 | 1 | 1 | 1 | 0 | 16 | 18 | 20 | 18 | 16 | 17 |
| 1 | 1 | 1 | 0 | 1 | 1 | 0 | 1 | 16 | 18 | 20 | 16 | 16 | 16 |
| 1 | 1 | 1 | 1 | 0 | 0 | 0 | 0 | 16 | 14 | 12 | 16 | 14 | 15 |
| 1 | 1 | 1 | 1 | 0 | 0 | 0 | 1 | 16 | 14 | 12 | 14 | 14 | 14 |
| 1 | 1 | 1 | 1 | 0 | 0 | 1 | 0 | 16 | 14 | 12 | 14 | 12 | 13 |
| 1 | 1 | 1 | 1 | 0 | 0 | 1 | 1 | 16 | 14 | 12 | 12 | 12 | 12 |
| 1 | 1 | 1 | 1 | 0 | 1 | 0 | 0 | 8 | 10 | 12 | 12 | 10 | 11 |
| 1 | 1 | 1 | 1 | 0 | 1 | 0 | 1 | 8 | 10 | 12 | 10 | 10 | 10 |
| 1 | 1 | 1 | 1 | 0 | 1 | 1 | 0 | 8 | 10 | 12 | 10 | 8 | 9 |
| 1 | 1 | 1 | 1 | 0 | 1 | 1 | 1 | 8 | 10 | 12 | 8 | 8 | 8 |
| 1 | 1 | 1 | 1 | 1 | 0 | 0 | 0 | 7 | 7 | – | 7 | 7 | 7 |
| 1 | 1 | 1 | 1 | 1 | 0 | 0 | 1 | – | 6 | – | 6 | 6 | 6 |
| 1 | 1 | 1 | 1 | 1 | 0 | 1 | 0 | – | 5 | 5 | 5 | 5 | 5 |
| 1 | 1 | 1 | 1 | 1 | 0 | 1 | 1 | – | – | 4 | 4 | 4 | 4 |
| 1 | 1 | 1 | 1 | 1 | 1 | 0 | 0 | – | 3 | 3 | 3 | 3 | 3 |
| 1 | 1 | 1 | 1 | 1 | 1 | 0 | 1 | – | 2 | – | 2 | 2 | 2 |
| 1 | 1 | 1 | 1 | 1 | 1 | 1 | 0 | 1 | 1 | – | 1 | 1 | 1 |
| 1 | 1 | 1 | 1 | 1 | 1 | 1 | 1 | 0 | – | – | 0 | 0 | 0 |

FIG. 24

800

| | 2 bit | 3 bit | 4 bit |
|---|---|---|---|
| a | 184 | 248 | 384 |
| b | 132 | 42 | 18 |
| a+b | 316 | 290 | 402 |

DISPLAY DEVICE

CROSS-REFERENCE TO RELATED APPLICATION

The present application claims priority from Japanese application JP 2009-087680 filed on Mar. 31, 2009, the content of which is hereby incorporated by reference into this application.

BACKGROUND OF THE INVENTION

1. Technical Field

The present invention relates to a display device, and more particularly, to a display device using a decoder circuit which outputs voltages corresponding to digital values.

2. Related Art

As a display device of an information communication terminal, such as a computer, or of a television receiver, a liquid crystal display device has been widely used. The liquid crystal display device is a device which, by changing the orientation of liquid crystal molecules enclosed between two substrates, changes the ratio of light transmitted therethrough, and controls an image to be displayed. A decoder circuit for outputting voltages corresponding to gradation values for each pixel is mounted on a drive circuit which drives this kind of liquid crystal display device. The size of the decoder circuit is increasing accompanying an increased number of gradations in recent years, due to which an area occupied by chips increases, so a reduction in the size has been required.

JP-A-2001-34234 discloses a technology of reducing the number of gradation wires, and the size of a decoder circuit, by using a two-input amplifier which, when two input voltages are the same, carries out an output using the input voltages, and when they are different, carries out an output using a voltage intermediate between the two voltages.

With the heretofore described literature, as it is possible, by using the intermediate voltage, to reduce kinds of voltage value acting as output signals to be prepared in advance, it is possible to reduce a circuit size as a whole. However, the circuit size of a decoder portion, which selects a plurality of kinds of voltage value, prior to a stage which outputs the intermediate voltage, has not been sufficiently studied.

The invention, bearing in mind the heretofore described circumstances, has an object of providing a display device the size of a decoder circuit of which is made smaller.

SUMMARY OF THE INVENTION

A display device according to the invention includes a display element, and a drive circuit which drives the display element. The drive circuit includes a decoder circuit which, based on 8-bit digital data, outputs voltages corresponding to the digital data, and the decoder circuit includes a predecoder circuit group which, by including three predecoder circuits, each of which outputs one voltage using a plurality of bits from among the digital data, outputs voltages to three output signal lines, a selection circuit section which, having input thereinto three voltages applied to the three output signal lines, selects two voltages of the three voltages using a plurality of bits from among the digital data, and applies the selected voltages to two of the output signal lines, and an intermediate voltage output circuit which, having input thereinto the two voltages selected by the selection circuit section, outputs a voltage which is the average of the two voltages. At least one predecoder circuit, among the three predecoder circuits, includes a first matrix type decoder circuit which carries out a three bits worth of decoding, and a first tournament type decoder circuit which carries out a three bits worth of decoding.

The matrix type decoder circuit is a decoder circuit including one transistor switch in each candidate signal line selected by the decoding, and the tournament type decoder circuit is a decoder circuit in which the number of candidate signal lines selected by the decoding decreases, each time passing through the transistor switch which carries out a decoding of each bit.

Also, with the display device of the invention, at least one predecoder circuit, among the three predecoder circuits of the predecoder circuit group, further includes a second matrix type decoder circuit which, being a matrix type of decoder circuit, carries out a two bits worth of decoding, and a second tournament type decoder circuit which, being a tournament type of decoder circuit, carries out a three bits worth of decoding.

Also, with the display device of the invention, the plurality of bits used by the selection circuit section are three bits.

Also, with the display device of the invention, the decoder circuit, further including a third tournament type decoder circuit which is a tournament type of decoder circuit, carries out an output by means of the third tournament type decoder circuit in the event that all of a predetermined plurality of upper bits of 8-bit digital values are 0, and in the event that all of the predetermined plurality of upper bits of the 8-bit digital values are 1.

BRIEF DESCRIPTION OF THE DRAWINGS

FIG. 22 is a table showing a relationship in upper 21 gradations between gradation values and outputs in the decoder circuit;

FIG. 23 is a table showing a relationship in lower 21 gradations between the gradation values and outputs in the decoder circuit of FIG. 3; and FIG. 24 is an element number table showing the number of elements.

DETAILED DESCRIPTION OF THE EMBODIMENT(S)

Figure 1:
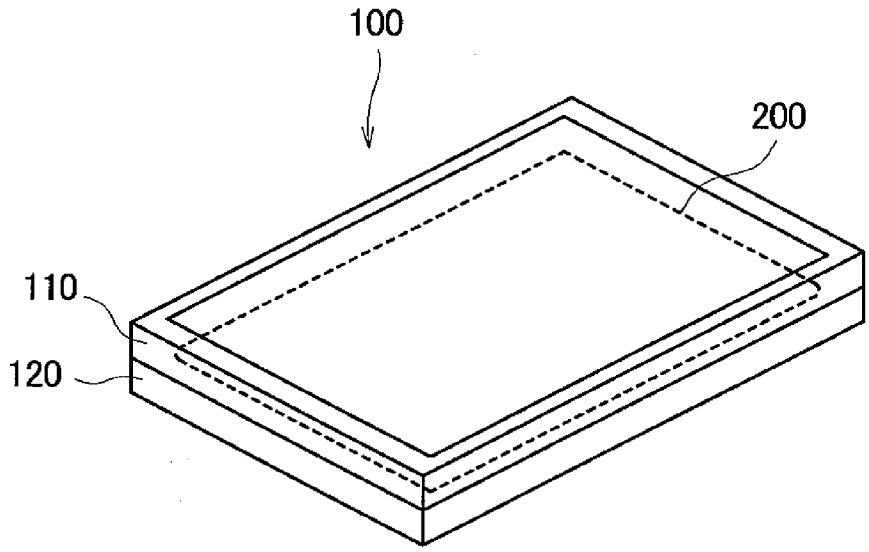
FIG. 1 is a diagram schematically showing a liquid crystal display device according to one embodiment of the invention.

Hereafter, a description will be given, referring to the drawings, of an embodiment of the invention. In the drawings, identical and similar components being indicated by identical reference characters and numerals, a redundant description will be omitted.

FIG. 1 schematically shows a liquid crystal display device 100 according to the embodiment of the invention. As shown in this diagram, the liquid crystal display device 100 is configured of a liquid crystal display panel 200 fixed so as to be sandwiched between an upper frame 110 and lower frame 120, an unshown backlight device, and the like.

Figure 2:
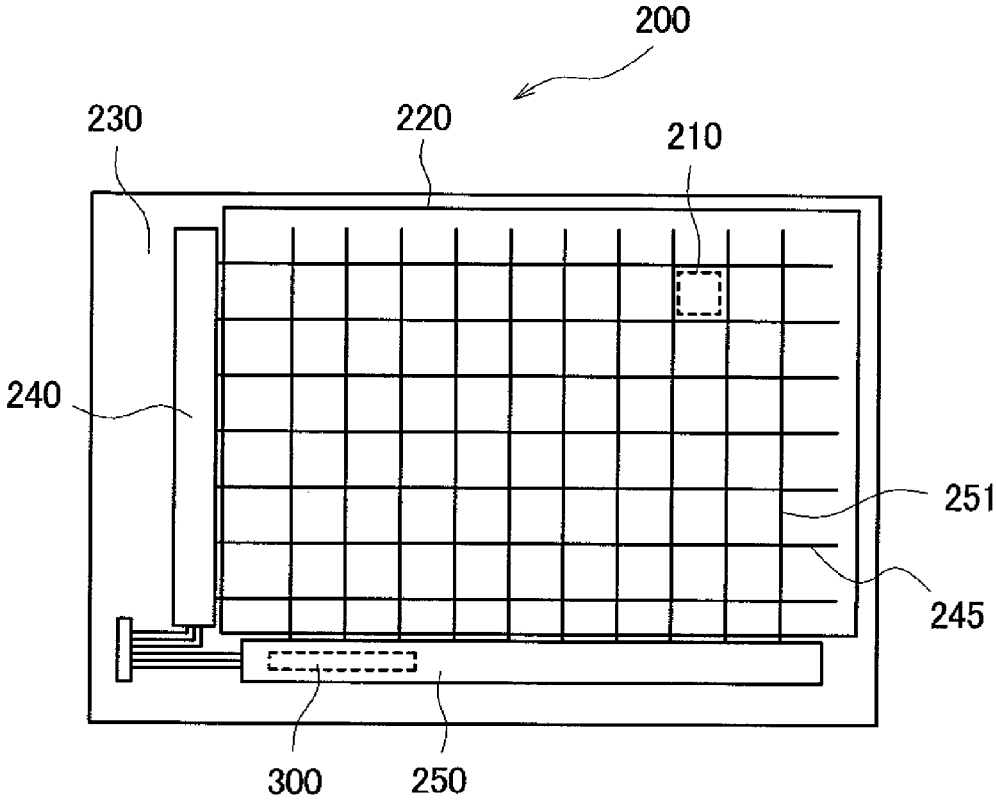
FIG. 2 is a diagram showing a configuration of a liquid crystal display panel of the liquid crystal display device of FIG. 1.

FIG. 2 shows a configuration of the liquid crystal display panel 200. The liquid crystal display panel 200 includes two substrates, a TFT substrate 230 and a color filter substrate 220, and a liquid crystal composition is enclosed between the substrates. Gate signal lines 245, controlled by a drive circuit 240, and drain signal lines 251, controlled by a drive circuit 250, are extended over the TFT substrate 230, and these signal lines form cells 210, each of which functions as one pixel of the liquid crystal display device 100. Also, the drive circuit 250 includes a decoder circuit 300 which converts 8-bit gradation values D<7:0>, which are video signals ("<7:0>" means that the signals are of eight bits from a zeroth bit to a seventh bit), into voltages. Although the liquid crystal display panel 200 has the number of cells 210 corresponding to its display resolution, an illustration thereof is simplified in FIG. 2 in order to avoid a complication of the illustration. Also, a control signal including the video signals is input into each of drive circuits 240 and 250 from an unshown processing device, controlling the orientation of the liquid crystal composition, and carrying out a display.

Figure 3:
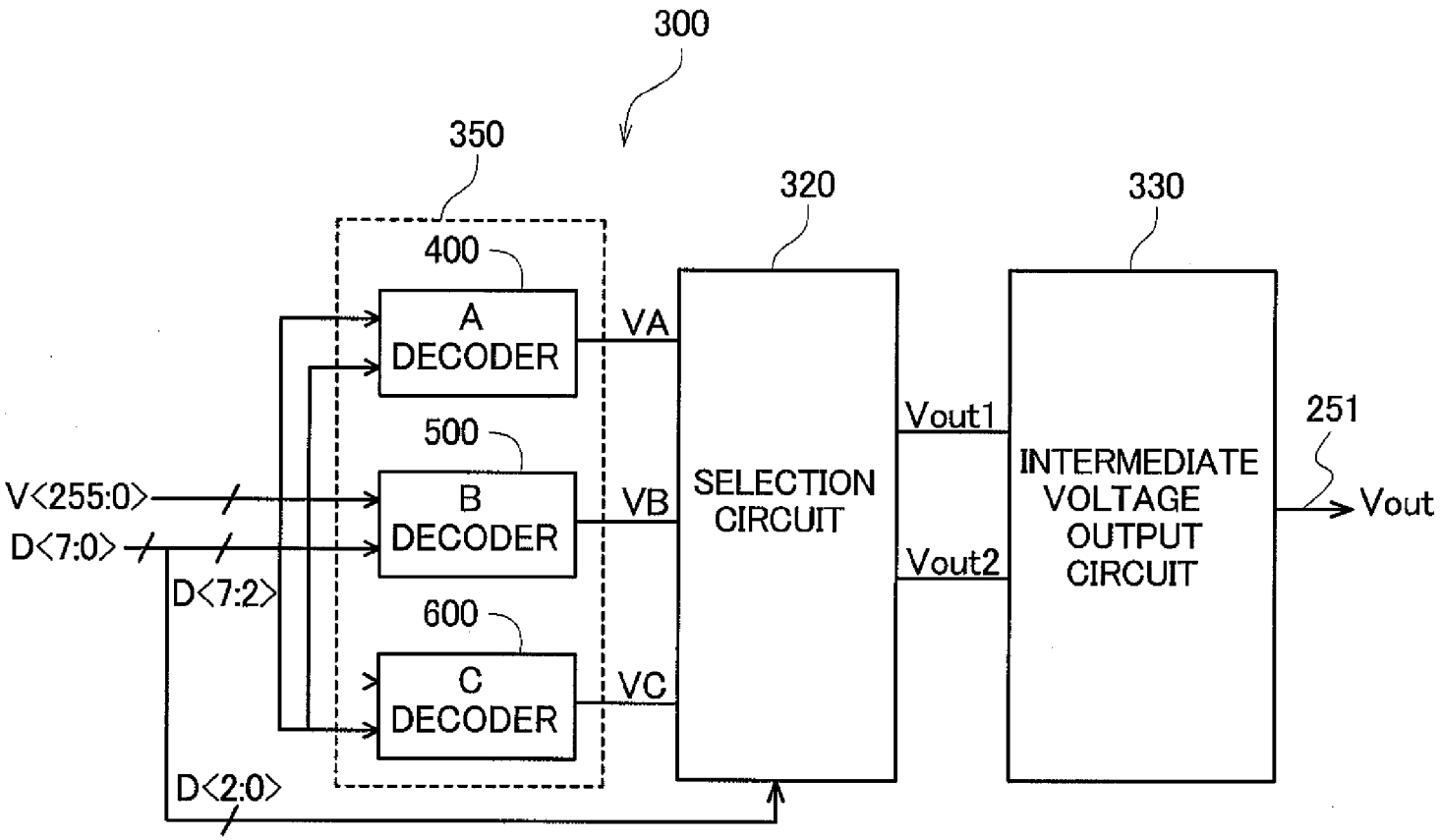
FIG. 3 is a diagram schematically showing a configuration of a decoder circuit of the liquid crystal display panel of FIG. 2.

FIG. 3 is a diagram schematically showing a configuration of the decoder circuit 300. As shown in the diagram, the decoder circuit 300 includes a predecoder section 350 which carries out a decoding using six bits' worth of gradation values D<7:2>, out of the 8-bit gradation values D<7:0>, and which carries out three outputs of voltages VA, VB, and VC, a selection circuit 320 which, based on gradation values D<2:0>, selects two voltages $V_{out1}$ and $V_{out2}$ from among the output voltages VA, VB, and VC, and outputs them, and an intermediate voltage output circuit 330 which outputs a voltage which is the average of the two voltages $V_{out1}$ and $V_{out2}$ selected.

That is, with the decoder circuit 300 shown in FIG. 3, it being configured of the predecoder section 350 including three six bits' worth of predecoder circuits, the selection circuit 320, and the intermediate voltage output circuit 330, it is possible to suppress a circuit size in comparison with a heretofore known circuit which decodes eight bits.

Herein, the predecoder section 350 including three decoders, an A decoder 400, B decoder 500, and C decoder 600, which are predecoder circuits, the 6-bit gradation values D<7:2>, out of the video signals represented by the 8-bit gradation values D<7:0>, are input, and voltage values V<255:0> are input, into each of the A decoder 400, B decoder 500, and C decoder 600. Herein, although a voltage output by the decoder circuit 300 is of one of 256 stages, as a voltage with an average of two voltage values can be output by the intermediate voltage output circuit 330 to be described hereafter, rather than 256 kinds of voltage being input, actually, 129 kinds of voltage value, out of the voltage values V<255:0>, are input into the decoder circuit 300.

Hereafter, a description will be given of a configuration of each of the A decoder 400, B decoder 500, C decoder 600, selection circuit 320, and intermediate voltage output circuit 330. A detailed description will be given in the description of the selection circuit 320 to be described hereafter, but a configuration is adopted such that the A decoder 400 outputs voltage values V<8n, n=1 to 32>, the B decoder 500 outputs voltage values V<4n+6, n=1 to 32>, and the C decoder 600 outputs voltage values V<8n+4, n=1 to 32>. Also, the notation of the voltage values V<8n> means voltage values corresponding to an 8 nth gradation.

Figure 4:
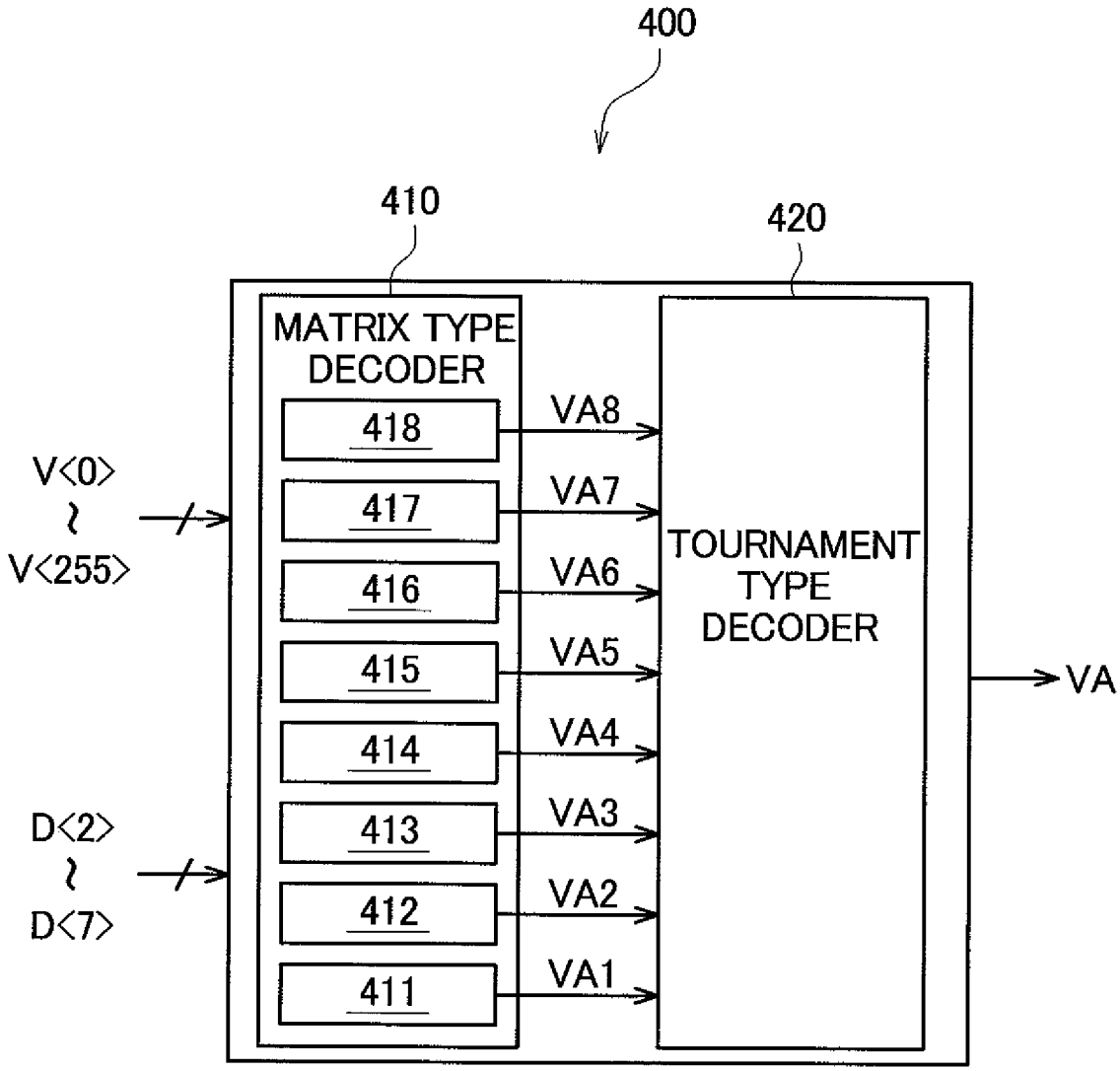
FIG. 4 is a diagram showing a configuration of an A decoder of FIG. 3.

FIG. 4 is a diagram showing a configuration of the A decoder 400 of FIG. 3. As shown in the diagram, the A decoder 400 is configured of a matrix type decoder 410 and tournament type decoder 420, to be described hereafter, and furthermore, the matrix type decoder 410 being divided into eight decoder blocks 411 to 418, outputs VA1 to VA8 of the individual decoder blocks are eight inputs of the tournament type decoder 420.

The A decoder 400 shown in FIG. 4, using lower 3-bit gradation values D<4:2>, out of the 6-bit gradation values D<7:2>, outputs eight voltages, from among the 129 kinds of voltage values, to the tournament type decoder 420 by means of the matrix type decoder 410.

That is, the A decoder 400 decodes the lower three bits, out of the 6-bit gradation values D<7:2>, by using the matrix type decoder 410, and the upper three bits by using the tournament type decoder 420.

Figure 5A:
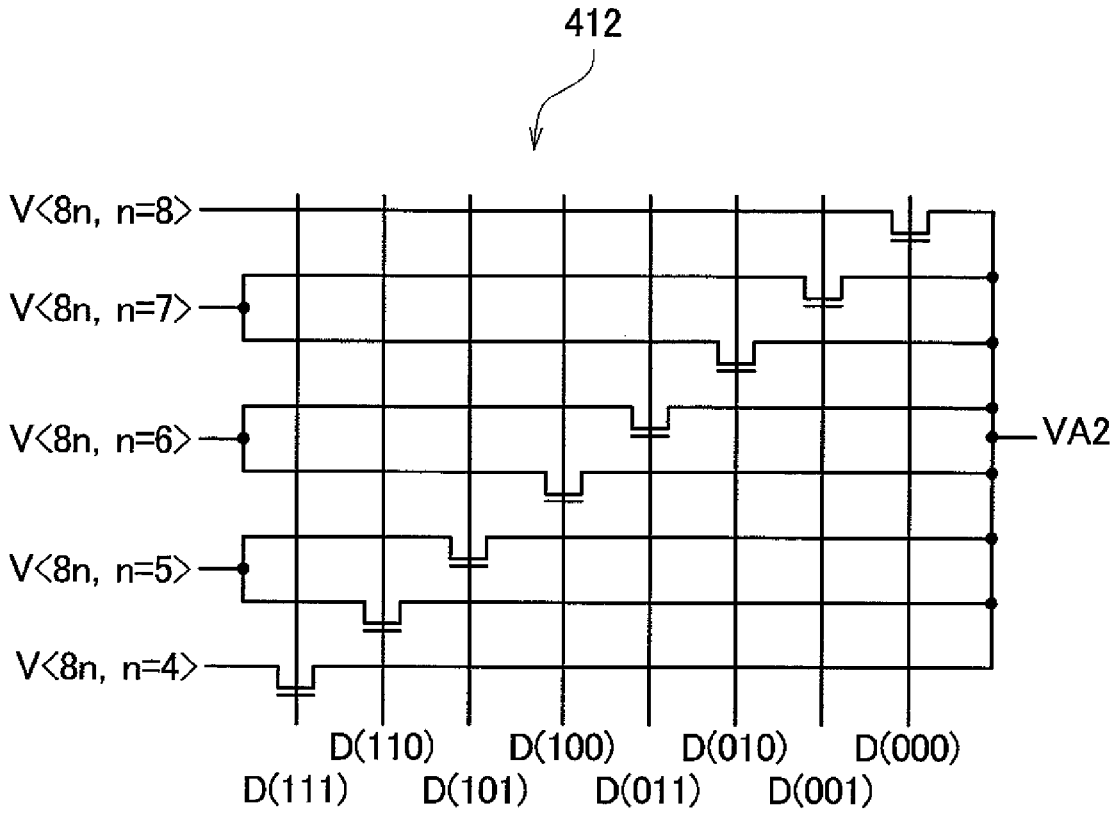
FIG. 5A is a circuit diagram of a decoder block of a matrix type decoder of FIG. 4.

FIG. 5A shows a circuit diagram of the decoder block 412 of the matrix type decoder 410. Although n-type transistors are depicted as switching elements in FIG. 5A, without being limited to this, it is possible to utilize p-type transistors, ones in which n types and p types are connected in parallel, or the like, as the switching elements. As shown in FIG. 4, voltage values included in a second block on the lower gradation side, among the eight blocks into which the 256 gradations have been divided, are input into the decoder block 412. For this reason, as shown in FIG. 5A, voltage values V<8n, n=4 to 8>, specifically, voltage values V<32>, V<40>, V<48>, V<56>, and V<64>, are input into the decoder block 412. The decoder block 412 being a matrix type of decoder which has one transistor switch in each of eight signal lines to which these voltages have been applied, selection signals based on the 3-bit gradation values D<4:2> are input into these transistor switches, and one voltage value VA2 is output.

Figure 5B:
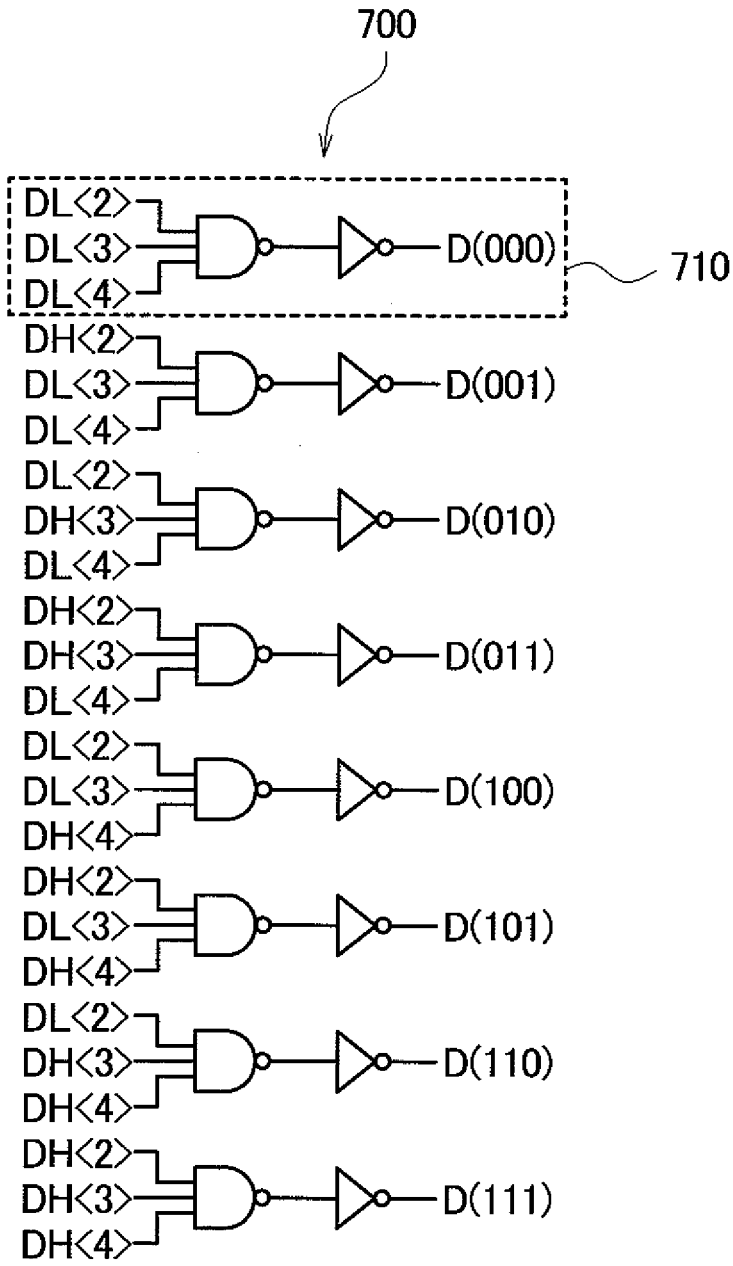
FIG. 5B is a diagram showing a configuration of a data selector circuit which generates selection signals of FIG. 5A.
Figures 5C, 6:
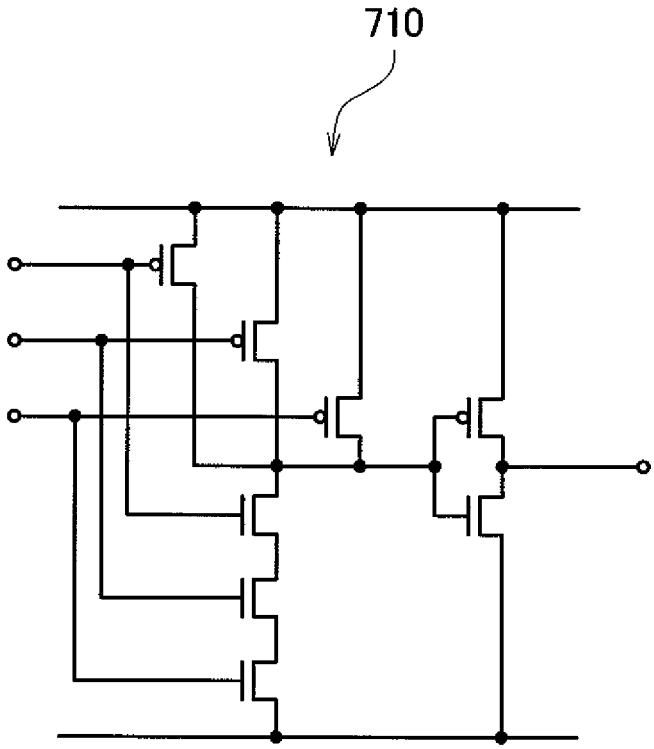
FIG. 5C is a diagram showing a configuration of multiplexer circuits of the data selector circuit of FIG. 5B.
FIG. 6 is a truth value table representing a relationship between an input and output of the decoder block of FIG. 4.

FIG. 5B shows a configuration of a data selector circuit 700 which outputs selection signals, which control a turning on and off of the transistor switches, from the 3-bit gradation values D<4:2>, while FIG. 5C shows multiplexer circuits 710, configuring the data selector circuit 700, each of which is configured of a combination of a NAND circuit and inverter circuit. As shown in FIGS. 5B and 5C, the data selector circuit 700 is configured of eight combinations of the NAND circuit and inverter circuit, each of which is configured of eight transistors. Consequently, the data selector circuit 700 can be configured of 64 transistors.

The notation DL indicates that a negative logic is of a high level, meaning that, for example, in the event that a value of a second bit is 0, DL<2>=1. Also, a notation such as D(001) means that D<2>=1, D<3>=0, and D<4>=0.

FIG. 6 shows a truth value table representing a relationship between an input and output of the decoder block 412. As represented in the truth value table, gradation voltages V<8n, n=4 to 8> are output for every eight gradations, and two of values represented by D<4:2> are assigned to each of V<40>, V<48>, and V<56>. The other decoder blocks 411 and 413 to 418 in the A decoder 400 are also configured in such a way that, in the same way as in the truth value table of FIG. 6, as well as the gradation voltages V<8n, n=4 to 8> being output for every eight gradations, two of values represented by D<4:2> are assigned to one voltage value, excluding a highest and lowest voltage value.

In FIG. 6, the notations in the section of the gradation values D<4:2> indicate values of individual bits and, for example, "100" indicates that D<4> is 1, and D<3> and D<0<2> are 0. The same applies to the other notations of the truth value table.

Figures 7, 8:
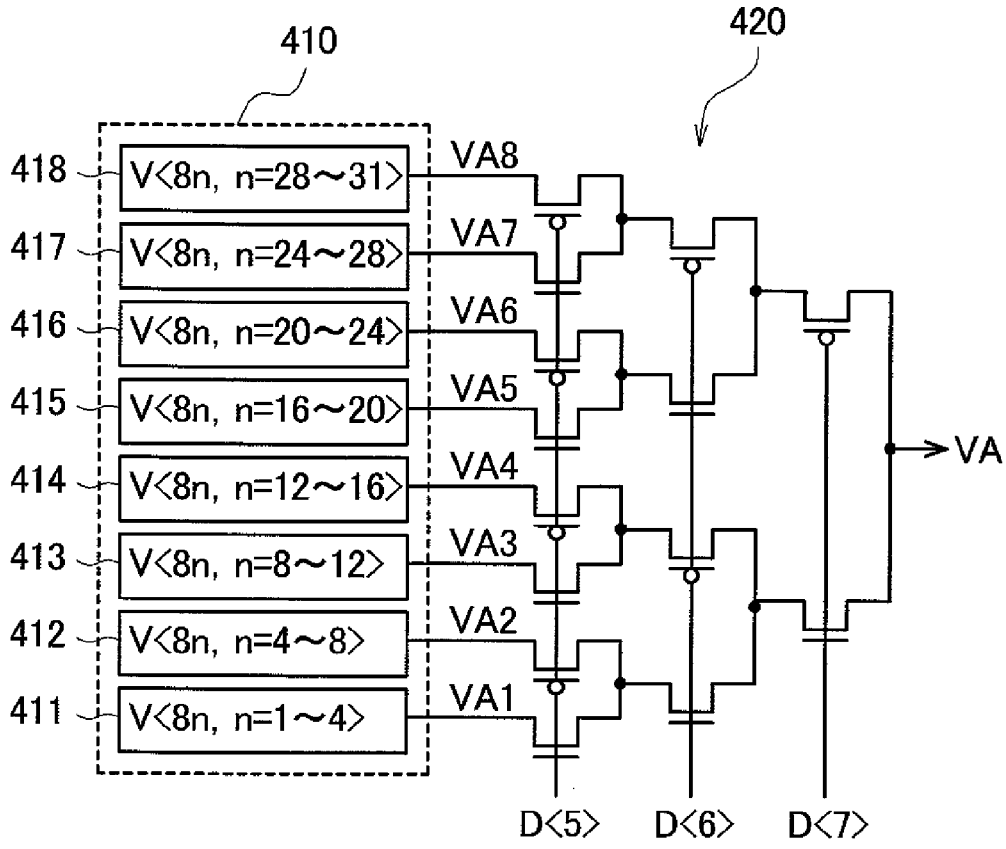
FIG. 7 shows a circuit diagram of a tournament type decoder of the A decoder of FIG. 4.
FIG. 8 is a truth value table representing a relationship between an input and output of the tournament type decoder of FIG. 4.

FIG. 7 shows a circuit diagram of the tournament type decoder 420 of the A decoder 400. As shown in the diagram, the tournament type decoder 420 being a tournament type decoder which narrows the number of output voltages to be selected down to a half, each time passing through a transistor switch which carries out a decoding of each bit, it inputs each of outputs VA1 to VA8 of the decoder blocks 411 to 418, and one voltage value is output based on gradation values D<7:5>.

FIG. 8 shows a truth value table representing a relationship between an input and output of the tournament type decoder 420. As shown in the truth value table, one of individual input voltage values is output based on the gradation values D<7:5>.

Figure 9:
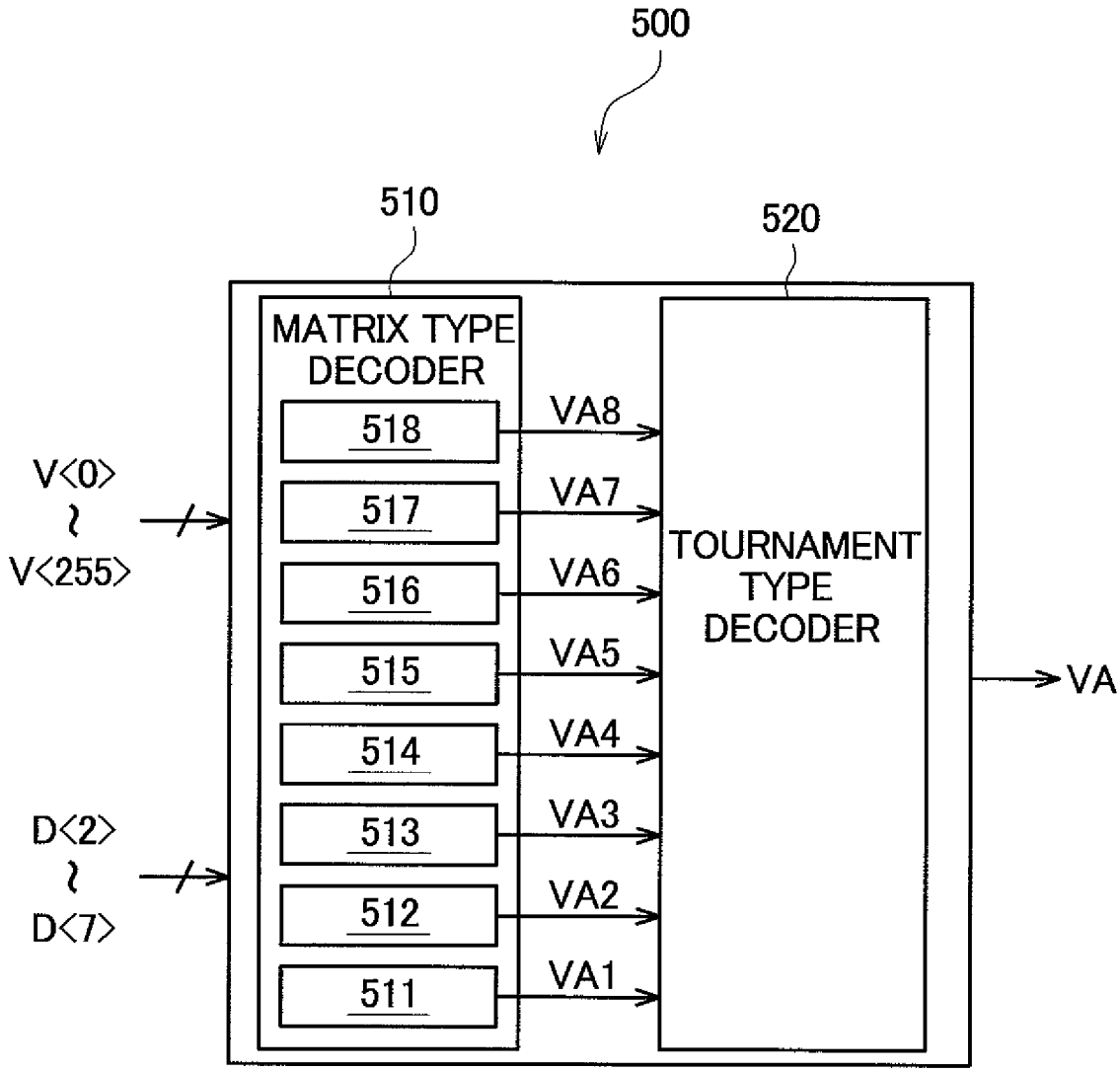
FIG. 9 is a diagram showing a configuration of a B decoder of FIG. 3.

FIG. 9 is a diagram showing a configuration of the B decoder 500 of FIG. 3. As shown in the diagram, the B decoder 500 is configured of a matrix type decoder 510 and tournament type decoder 520, and furthermore, the matrix type decoder 510 being divided into eight decoder blocks 511 to 518, outputs VB1 to VB8 of the individual decoder blocks are eight inputs of the tournament type decoder 520.

Figures 10, 11:
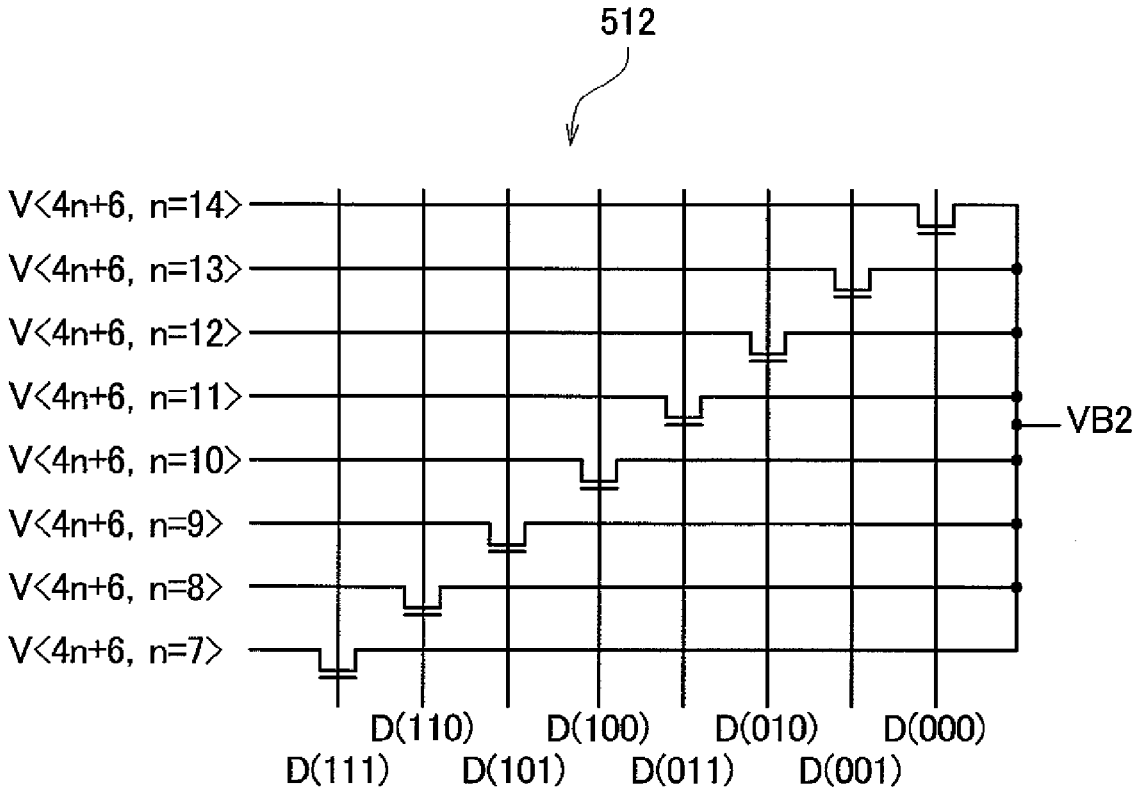
FIG. 10 is a circuit diagram of a decoder block of a matrix type decoder of FIG. 9.
FIG. 11 is a truth value table representing a relationship between an input and output of the decoder block of FIG. 9.

FIG. 10 shows a circuit diagram of the decoder block 512 of the matrix type decoder 510. As shown in the diagram, voltage values V<4n+6, n=7 to 14>, specifically, voltage values V<34>, V<38>, V<42>, V<46>, V<50>, V<54>, V<58>, and V<62>, are input into the decoder block 512. The decoder block 512 being a matrix type of decoder which has one transistor switch in each of eight signal lines to which these voltages have been applied, selection signals based on the 3-bit gradation values D<4:2> are input into these transistor switches, and one voltage value VB2 is output.

FIG. 11 shows a truth value table representing a relationship between an input and output of the decoder block 512. As represented in the truth value table, gradation voltages V<4n+6, n=7 to 14> are output for every four gradations. The other decoder blocks 511 and 513 to 518 in the B decoder 500 are also configured in such a way that, in the same way as in the truth value table of FIG. 10, the gradation voltages V<4n+6, n=7 to 14> are output for every four gradations.

Figures 12, 13:
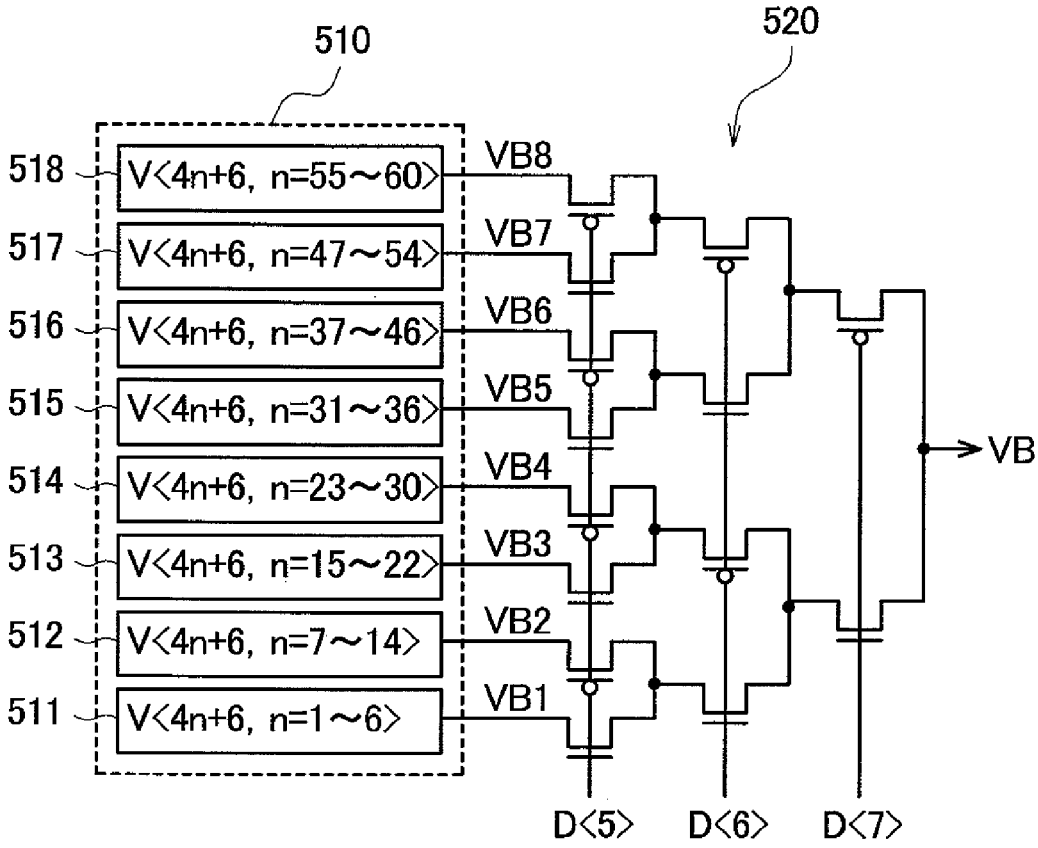
FIG. 12 shows a circuit diagram of a tournament type decoder of the B decoder of FIG. 9.
FIG. 13 is a truth value table representing a relationship between an input and output of the tournament type decoder of FIG. 9.

FIG. 12 shows a circuit diagram of the tournament type decoder 520 of the B decoder 500. As shown in the diagram, the tournament type decoder 520 being a tournament type of decoder which narrows the number of output voltages to be selected down to a half, each time passing through a transistor switch which carries out a decoding of each bit, it inputs each of outputs VB1 to VB8 of the decoder blocks 511 to 518, and one voltage value is output based on the gradation values D<7:5>.

FIG. 13 shows a truth value table representing a relationship between an input and output of the tournament type decoder 520. As shown in the truth value table, one of the individual input voltage values is output based on the gradation values D<7:5>.

Figure 14:
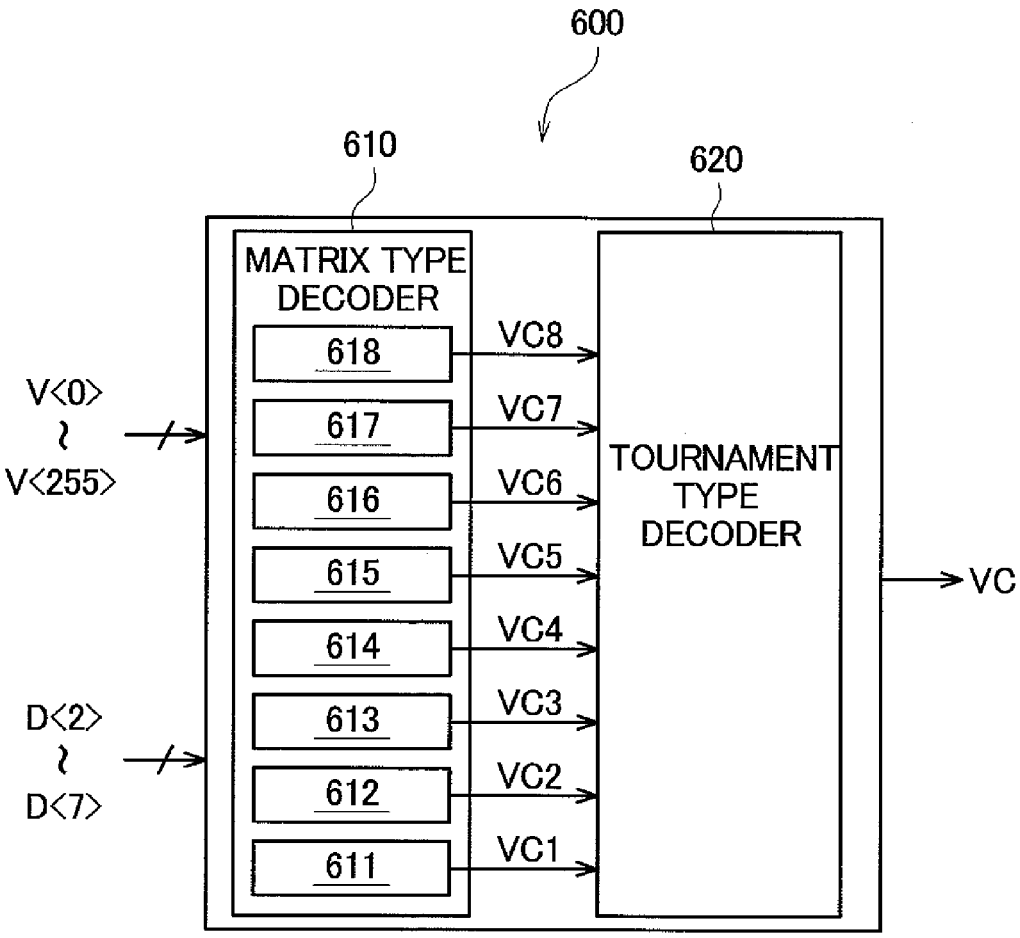
FIG. 14 is a diagram showing a configuration of a C decoder of FIG. 3.

FIG. 14 is a diagram showing a configuration of the C decoder 600 of FIG. 3. As shown in the diagram, the C decoder 600 is configured of a matrix type decoder 610 and tournament type decoder 620, and furthermore, the matrix type decoder 610 being divided into eight decoder blocks 611 to 618, outputs VC1 to VC8 of the individual decoder blocks are eight inputs of the tournament type decoder 620.

Figure 15A:
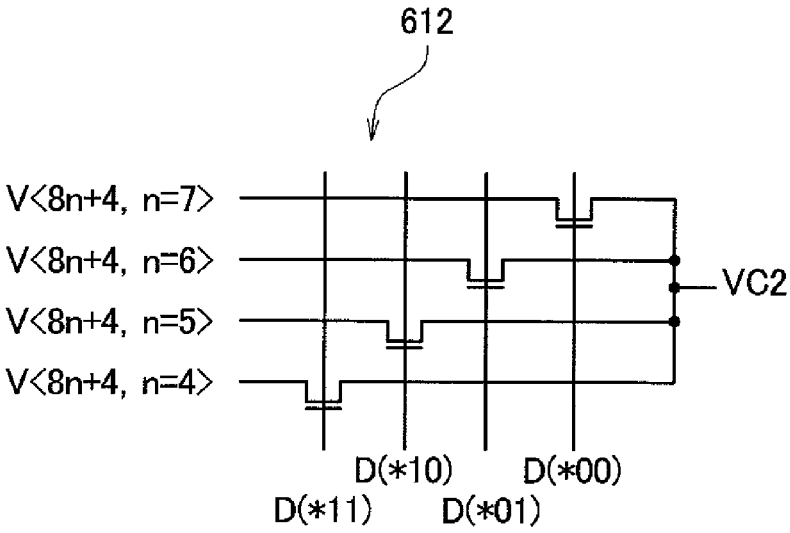
FIG. 15A is a circuit diagram of a decoder block of a matrix type decoder of FIG. 14.

FIG. 15A shows a circuit diagram of the decoder block 612 of the matrix type decoder 610. As shown in the diagram, voltage values V<8n+4, n=4 to 7>, specifically, voltage values V<36>, V<44>, V<52>, and V<60>, are input into the decoder block 612. The decoder block 612 being a matrix type of decoder which has one transistor switch in each of four signal lines to which these voltages have been applied, selection signals based on gradation values D<3> and D<4> are input into these transistor switches, and one voltage value is output.

Figure 15B:
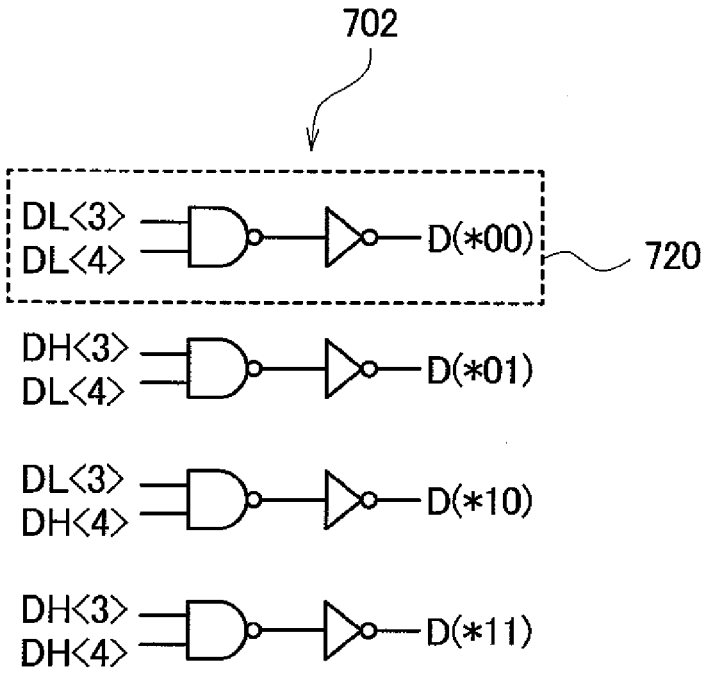
FIG. 15B is a diagram showing a configuration of a data selector circuit which generates selection signals of FIG. 15A.
Figure 15C:
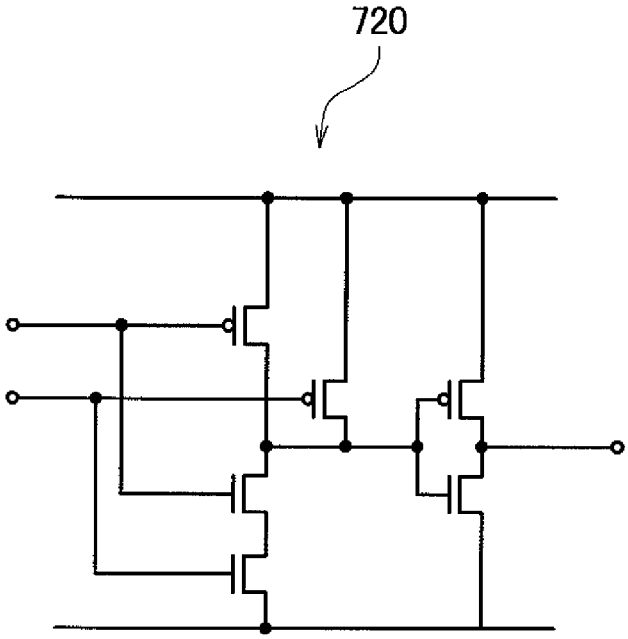
FIG. 15C is a diagram showing a configuration of multiplexer circuits of the data selector circuit of FIG. 15B.

FIG. 15B shows a configuration of a data selector circuit 702 which outputs selection signals, which control a turning on and off of the transistor switches, from 2-bit gradation values D<4:3>, while FIG. 15C shows multiplexer circuits 720, configuring the data selector circuit 702, each of which is configured of a combination of a NAND circuit and inverter circuit. As shown in FIGS. 15B and 15C, the data selector circuit 702 is configured of four combinations of the NAND circuit and inverter circuit, each of which is configured of six transistors. Consequently, the data selector circuit 702 can be configured of 24 transistors. The notation D(*00) in the diagram means that D<2> is optional.

Figures 16, 17:
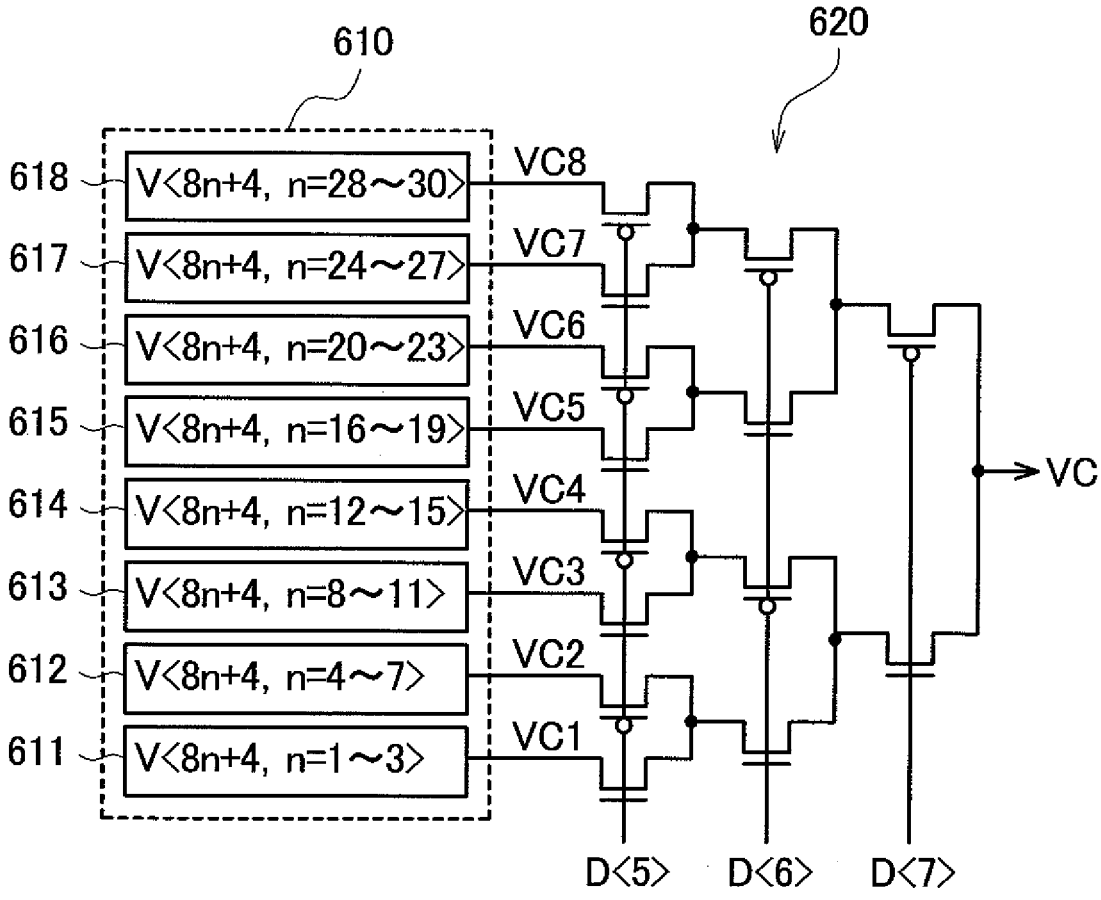
FIG. 16 is a truth value table representing a relationship between an input and output of the decoder block of FIG. 14.
FIG. 17 shows a circuit diagram of a tournament type decoder of the C decoder of FIG. 14.

FIG. 16 shows a truth value table representing a relationship between an input and output of the decoder block 612. As represented in the truth value table, gradation voltages V<8n+4, n=4 to 7> are output for every eight gradations. The other decoder blocks 611 and 613 to 618 in the C decoder 600 are also configured in such a way that, in the same way as in the truth value table of FIG. 16, the gradation voltages V<8n+4, n=4 to 7> are output for every eight gradations.

FIG. 17 shows a circuit diagram of the tournament type decoder 620 of the C decoder 600. As shown in the diagram, the tournament type decoder 620 being a tournament type of decoder which narrows the number of output voltages to be selected down to a half, each time passing through a transistor switch which carries out a decoding of each bit, it inputs each of outputs VC1 to VC8 of the decoder blocks 611 to 618, and one voltage value is output based on the gradation values D<7:5>.

Figures 18, 19:
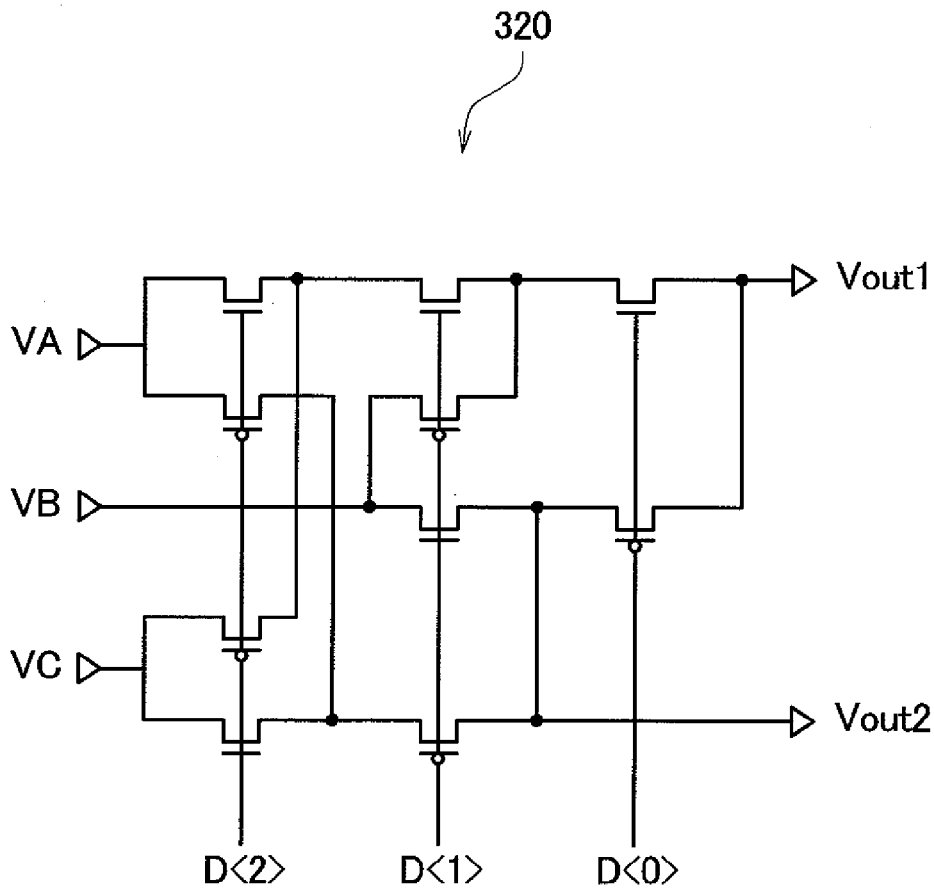
FIG. 18 is a truth value table representing a relationship between an input and output of the tournament type decoder of FIG. 14.
FIG. 19 shows a circuit diagram of a selection circuit of FIG. 3.

FIG. 18 shows a truth value table representing a relationship between an input and output of the tournament type decoder 620. As shown in the truth value table, one of the individual input voltage values is output based on the gradation values D<7:5>.

Figures 20, 21:
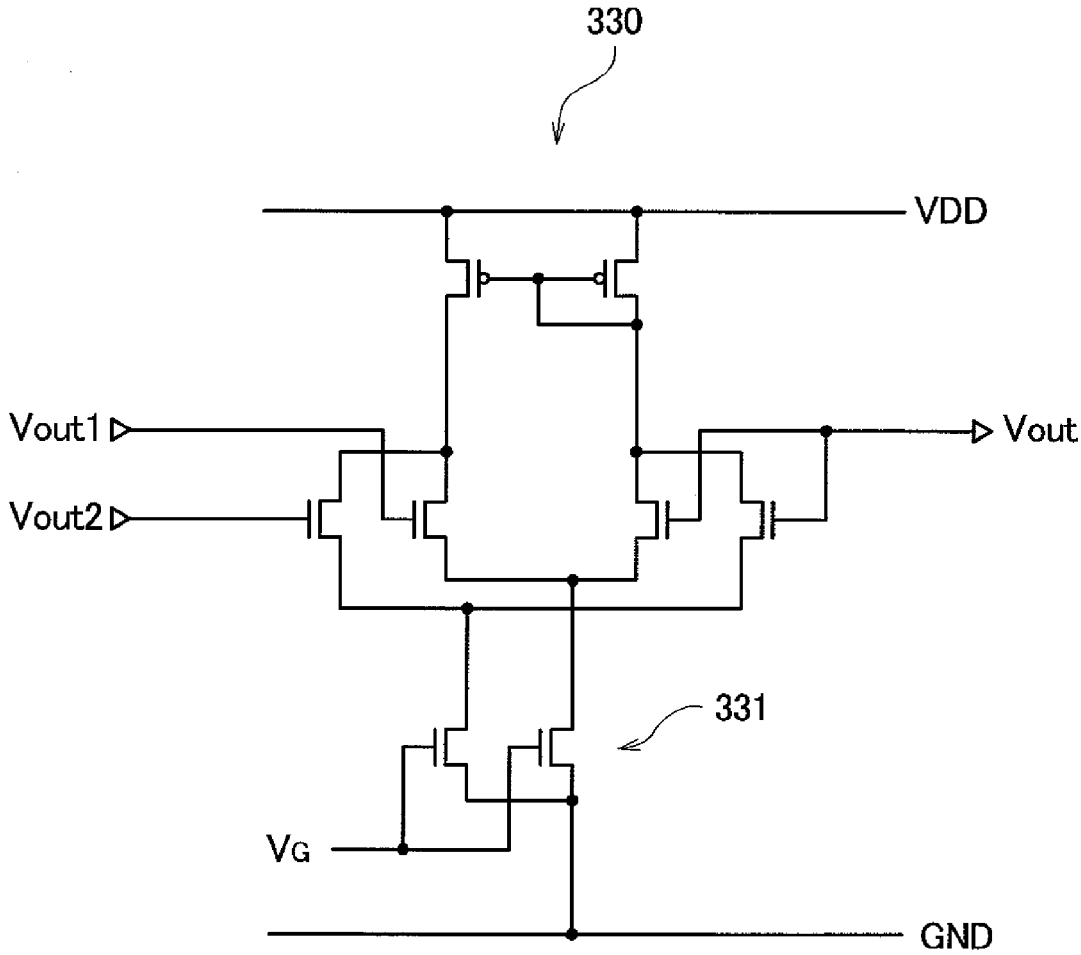
FIG. 20 is a truth value table representing an input and output of the selection circuit of FIG. 3.
FIG. 21 shows a circuit diagram of an intermediate voltage output circuit of FIG. 3.

FIG. 19 shows a circuit diagram of the selection circuit 320 of FIG. 3. As shown in the diagram, the selection circuit 320 is a circuit which, based on the gradation values D<2:0>, carries out two outputs $V_{out1}$ and $V_{out2}$ from three inputs of voltages VA, VB, and VC. FIG. 20 shows a truth value table representing a relationship between an input and output of the circuit. As shown in the truth value table, in both $V_{out1}$ and $V_{out2}$, each of the voltages VA and VC is selected at two differing gradation values, while the voltage VB is selected at four differing gradation values, but the voltages selected in the output $V_{out2}$ are shifted one gradation value's worth of block down in comparison with those in the output $V_{out1}$.

FIG. 21 shows a circuit diagram of the intermediate voltage output circuit 330 of FIG. 3. The intermediate voltage output circuit 330, being a circuit including a constant current source 331, inputs $V_{out1}$ and $V_{out2}$, and outputs a voltage $V_{out}$ which is an average thereof. Also, when the same voltage is input into $V_{out1}$ and $V_{out2}$, the input voltage is output from $V_{out}$.

Consequently, by using the intermediate voltage output circuit 330 described in FIG. 21, it becomes possible to output twice the gradation voltage but, as it is necessary to generate voltages to be input into $V_{out1}$ and $V_{out2}$ in the decoder circuit, the circuit size is not substantially reduced.

Therein, by using the selection circuit 320 shown in FIG. 19 to select two outputs from three inputs, it becomes possible to decode four times the gradation with three decoder circuits. Furthermore, when interchanging the connections of the voltage VA and voltage VC input into the selection circuit 320 using the gradation value D<2>, as shown in the truth value table of FIG. 20, it is possible to reduce the configuration of switching elements controlled using the gradation value D<2> of the C decoder 600.

FIGS. 22 and 23 show a relationship between the gradation values D<7:0>, which are the input video signals, and the output in each stage, in the decoder circuit 300 of FIG. 3 configured of the heretofore described kinds of circuit, for upper 21 gradations (FIG. 22) and lower 21 gradations (FIG. 23). Herein, with the upper eight gradations $V_{out}$<248 to 255> and lower eight gradations $V_{out}$<0 to 7>, taking into account a γ character of a relationship between the gradation voltages and brightness of the liquid crystal display device 100, each voltage value is output using an unshown tournament type decoder, rather than using the intermediate voltage output circuit 330. Consequently, the outputs using the heretofore described configurations of FIGS. 3 to 21 are carried out between the eighth gradation $V_{out}$<8> and 247th gradation $V_{out}$<247>. As shown in FIGS. 22 and 23, by inputting the gradation values D<7:0>, it is possible to obtain a desired output $V_{out}$.

Herein, although each of the A decoder, B decoder, and C decoder is divided into the matrix type decoder and tournament type decoder, the decoder circuit size varies depending on the number of bits decoded by the matrix type decoder. In the kind of 8-bit decoder in the heretofore described embodiment, when compiling changes in the number of elements in a case of changing the number of bits decoded in the matrix type decoder, the kind of element number table 800 of FIG. 24 is obtained.

In FIG. 24, "a" indicates the number of switching elements in the matrix type decoder, while "b" indicates the number of switching elements in the tournament type decoder. The number of switching elements in the data selector circuit 700 is added to the number of elements in the matrix type decoder.

In FIG. 24, when decoding six bits, a case in which the matrix type decoder handles two bits is represented by two bits, in which case the tournament type decoder handles four bits.

With regard to the breakdown of the element number table 800, in a case in which the matrix type decoder handles three bits, the number "a" of switching elements in the matrix type decoder is as follows. The matrix type decoder 410 shown in FIG. 4, as it includes eight decoder blocks, and the decoder block shown in FIG. 5 is configured of eight switching elements, is configured of 64 switching elements in total. The matrix type decoder 510 shown in FIG. 9, as it includes eight decoder blocks, and the decoder block shown in FIG. 10 is configured of eight switching elements, is configured of 64 switching elements in total. The matrix type decoder 610 shown in FIG. 14, as it includes eight decoder blocks, and the decoder block shown in FIG. 15 is configured of four switching elements, is configured of 32 switching elements in total. Besides, when adding 64 switching elements configuring the data selector circuit 700, and 24 switching elements configuring the data selector circuit 702, to the above total number, the number "a" of switching elements comes to a total of 248.

The number "b" of switching elements in the tournament type decoder is as follows. In the case of three bits, as the tournament type decoder 420 shown in FIG. 4 is configured of 14 switching elements, as shown in FIG. 7, the tournament type decoder 520 shown in FIG. 9 is configured of 14 switching elements, as shown in FIG. 12, and the tournament type decoder 620 shown in FIG. 14 is configured of 14 switching elements, as shown in FIG. 17, the number "b" of switching elements comes to a total of 42. Therefore, a+b is 290.

In a case in which the matrix type decoder handles two bits, the number "a" of switching elements in the matrix type decoder is as follows. The matrix type decoder 410 shown in FIG. 4, as it includes 16 decoder blocks, and the decoder block shown in FIG. 5 is configured of four switching elements, is configured of 64 switching elements in total. The matrix type decoder 510 shown in FIG. 9, as it includes 16 decoder blocks, and the decoder block shown in FIG. 10 is configured of four switching elements, is configured of 64 switching elements in total. The matrix type decoder 610 shown in FIG. 14, as it includes 16 decoder blocks, and the decoder block shown in FIG. 15 is configured of two switching elements, is configured of 32 switching elements in total. Besides, when adding 24 switching elements configuring the data selector circuit 700 to the above total number, the number "a" of switching elements comes to a total of 184.

The number "b" of switching elements in the tournament type decoder is as follows. In the case of four bits, as the tournament type decoder 420 shown in FIG. 4 is configured of 44 switching elements shown in FIG. 7, the tournament type decoder 520 shown in FIG. 9 is configured of 44 switching elements shown in FIG. 12, and the tournament type decoder 620 shown in FIG. 14 is configured of 44 switching elements shown in FIG. 17, the number "b" of switching elements comes to a total of 132. Therefore, a+b is 316.

In a case in which the matrix type decoder handles four bits, the number "a" of switching elements in the matrix type decoder is as follows. The matrix type decoder 410 shown in FIG. 4, as it includes four decoder blocks, and the decoder block shown in FIG. 5 is configured of 16 switching elements, is configured of 64 switching elements in total. The matrix type decoder 510 shown in FIG. 9, as it includes four decoder blocks, and the decoder block shown in FIG. 10 is configured of 16 switching elements, is configured of 64 switching elements in total. The matrix type decoder 610 shown in FIG. 14, as it includes four decoder blocks, and the decoder block shown in FIG. 15 is configured of eight switching elements, is configured of 32 switching elements in total. Besides, when adding 160 switching elements configuring the data selector circuit 700, and 64 switching elements configuring the data selector circuit 702, to the above total number, the number "a" of switching elements comes to a total of 384.

The number "b" of switching elements in the tournament type decoder is as follows. In the case of two bits, as the tournament type decoder 420 shown in FIG. 4 is configured of six switching elements shown in FIG. 7, the tournament type decoder shown 520 in FIG. 9 is configured of six switching elements shown in FIG. 12, and the tournament type decoder 620 shown in FIG. 14 is configured of six switching elements shown in FIG. 17, the number "b" of switching elements comes to a total of 18. Therefore, a+b is 402.

As shown in the element number table 800, by making the number of bits decoded in the matrix type decoder three bits, as in the embodiment, it is possible to minimize the circuit size.

As heretofore described, according to the embodiment, as it is possible to minimize the number of elements in the decoder circuit, it is possible to reduce the size of the decoder circuit.

What is claimed is:

1. A display device comprising:

a display element; and a drive circuit which drives the display element, the drive circuit including a decoder circuit which outputs voltages based on digital data, and the decoder circuit including three predecoder circuits, a selection circuit section into which voltages output from the three predecoder circuits are input, and which selects two voltages of the three voltages, and an intermediate voltage output circuit which, having input thereinto the two voltages selected by the selection circuit section, outputs a voltage which is the average of the two voltages, wherein each of the predecoder circuits includes a matrix type decoder circuit including one transistor switch in each candidate signal line selected by a decoding, and a tournament type decoder circuit in which the number of candidate signal lines selected by the decoding decreases, each time passing through the transistor switch which carries out a decoding of each bit, wherein at least a first one of the predecoder circuits includes a matrix type decoder circuit which comprises pairs of candidate signal lines each formed by two candidate signal lines connected to each other to receive the same input voltage by each of the two candidate signal lines comprising a pair, and wherein at least a second one of the predecoder circuits includes a matrix type decoder circuit which has only a plurality of individual candidate signal lines which each receive a different input voltage, and wherein at least a third one of the predecoder circuits includes a matrix type decoder circuit which has a smaller number of selection signals than either the first or second ones of the predecoder circuits.

2. A display device according to claim 1, wherein at least one predecoder circuit, among the three predecoder circuits, further includes a second matrix type decoder circuit which carries out a two bits' worth of decoding, and a second tournament type decoder circuit which carries out a three bits' worth of decoding.

3. A display device according to claim 1, wherein the selection circuit section uses three bits of the digital data.

4. A display device according to claim 1, wherein the decoder circuit, further including a third tournament type decoder circuit, carries out an output from the third tournament type decoder circuit in the event that upper bits of the digital data are 0.

5. A display device comprising:

a display element; and a drive circuit which drives the display element, the drive circuit including a decoder circuit which outputs voltages based on digital data, and the decoder circuit including three predecoder circuits, a selection circuit section into which voltages output from the three predecoder circuits are input, and which selects two voltages of the three voltages, and an intermediate voltage output circuit which, having input thereinto the two voltages selected by the selection circuit section, outputs a voltage which is the average of the two voltages, wherein each of the predecoder circuits includes a matrix type decoder circuit including one transistor switch in each candidate signal line selected by a decoding, a tournament type decoder circuit in which the number of candidate signal lines selected by the decoding decreases, each time passing through the transistor switch which carries out a decoding of each bit, and a data selector circuit which outputs selection signals, which control a turning on and off of the transistor switches of the matrix type decoder circuit, wherein at least a first one of the predecoder circuits includes a matrix type decoder circuit which comprises pairs of candidate signal lines each formed by two candidate signal lines connected to each other to receive the same input voltage by each of the two candidate signal lines comprising a pair, and wherein at least a second one of the predecoder circuits includes a matrix type decoder circuit which has only a plurality of individual candidate signal lines which each receive a different input voltage, and wherein at least a third one of the predecoder circuits includes a matrix type decoder circuit which has a smaller number of selection signals than either the first or second ones of the predecoder circuits.

6. A display device according to claim 5, wherein at least one predecoder circuit, among the three predecoder circuits, further includes a second matrix type decoder circuit which carries out a two bits' worth of decoding, and a second tournament type decoder circuit which carries out a three bits' worth of decoding.

7. A display device according to claim 5, wherein the selection circuit section uses three bits of the digital data.

8. A display device according to claim 5, wherein the decoder circuit, further including a third tournament type decoder circuit, carries out an output from the third tournament type decoder circuit in the event that upper bits of the digital data are 0.

9. A display device according to claim 5, wherein the data selector circuit, further including a NAND circuit and an inverter circuit.

* * * * *